US005511400A

United States Patent [19]

Ma

[11] Patent Number: 5,511,400

[45] Date of Patent: Apr. 30, 1996

[54] LOCK MECHANISM FOR USE IN A SECURING DEVICE

[76] Inventor: Ding-Chiang Ma, No. 40, Lane 121, Hai Huan Street, Tainan, Taiwan

[21] Appl. No.: 319,588

[22] Filed: Oct. 7, 1994

[51] Int. Cl.[6] ..... E05B 67/24

[52] U.S. Cl. ..... 70/38 R; 70/39; 70/43; 70/360; 70/379 R

[58] Field of Search ..... 70/360, 361, 379 R, 70/379 A, 380, 38 R, 38 B, 38 C, 39, 41–44, 28, 128, DIG. 79

[56] References Cited

U.S. PATENT DOCUMENTS

| | | | |
|---|---|---|---|
| 925,455 | 6/1909 | Campbell | 70/361 |
| 1,350,392 | 8/1920 | Taylor | 70/43 |
| 1,512,589 | 10/1924 | Freysinger | 70/39 |
| 1,512,590 | 10/1924 | Freysinger | 70/39 |
| 1,821,130 | 9/1931 | Wharam | 70/379 R |
| 4,369,642 | 1/1983 | Grell | 70/380 X |
| 4,633,686 | 1/1987 | Carr | 70/179 |
| 4,730,470 | 3/1988 | Zane et al. | 70/41 X |
| 5,253,496 | 10/1993 | Wang | 70/38 R |
| 5,400,624 | 3/1995 | Shieh | 70/39 X |
| 5,410,895 | 5/1995 | Hsu et al. | 70/39 |

FOREIGN PATENT DOCUMENTS

| | | | |
|---|---|---|---|
| 43548 | 8/1910 | Austria | 70/39 |
| 476229 | 3/1992 | European Pat. Off. | 70/39 |
| 895516 | 1/1945 | France | 70/38 C |
| 525897 | 3/1932 | Germany | 70/38 C |
| 179212 | 6/1923 | United Kingdom | 70/38 C |

*Primary Examiner*—Lloyd A. Gall
*Attorney, Agent, or Firm*—Morton J. Rosenberg; David I. Klein

[57] ABSTRACT

A lock mechanism having an engaging member, a sliding member, a fixed member, and a lock rod assembly received within an elongate lock rod housing is provided. The engaging member includes a planar head having a groove formed therein adapted to receive a protuberance extending axially from one end of the lock core. The engaging member also includes a shank portion extending axially from the head through which is formed a bore adapted to receive therein a spring member. The sliding member has an oval shaped axial through opening and a cam surface defined by an undulating annulus having depressed segments and protruding segments. The fixed member also includes an axial through opening and a cam surface defined by depressed segments and protruding segments. The two cam surfaces form a camming interface, whereby the shank of the engaging member is axially advanced and retracted into and out of locking engagement with the lock rod assembly by rotating the sliding member.

1 Claim, 3 Drawing Sheets

LOCK MECHANISM FOR USE IN A SECURING DEVICE

FIELD OF THE INVENTION

This invention relates to a lock mechanism, and more specifically, to a lock mechanism for use in a securing device of the kind used for securing in place motor bikes or other vehicles.

BACKGROUND OF THE INVENTION

Securing devices have become increasingly important with the continuing increase in theft crimes. As a result, locking devices of various kinds have been developed to meet various needs in protecting against such crime. Despite these developments, the basic structure of the locking mechanism in devices for securing motor bikes or other vehicles has remained relatively unchanged. For instance, a prior art locking mechanism, as shown in FIGS. 4A, 4B, 5A, and 5B, comprises an elongate lock housing A having an axial bore adapted to receive a lock core B and a side opening for insert of a lock rod assembly C therethrough. The lock core B has an integral engaging plate B1 extending from an end portion thereof. The lock rod assembly C has a recessed portion at a lower part thereof and a dome C1 centered on one face of the recessed portion. The dome C1 is blocked by the engaging plate B1 from moving upward when the engaging plate B1 is in its locked position. A clearance exists between the engaging plate B1 and the dome C1 when plate B1 is in that locked position, resulting in loose engagement of the plate B1 with the dome Cl.

SUMMARY OF THE INVENTION

It is the primary object of the present invention to provide a lock mechanism wherein the locking engagement of parts is a secure one.

It is another object of the present invention to provide a lock mechanism embodying simple operability.

It is yet another object of the present invention to provide a lock mechanism which may be easily manufactured.

DETAILED DESCRIPTION OF THE PREFERRED EMBODIMENTS

Figure 1:
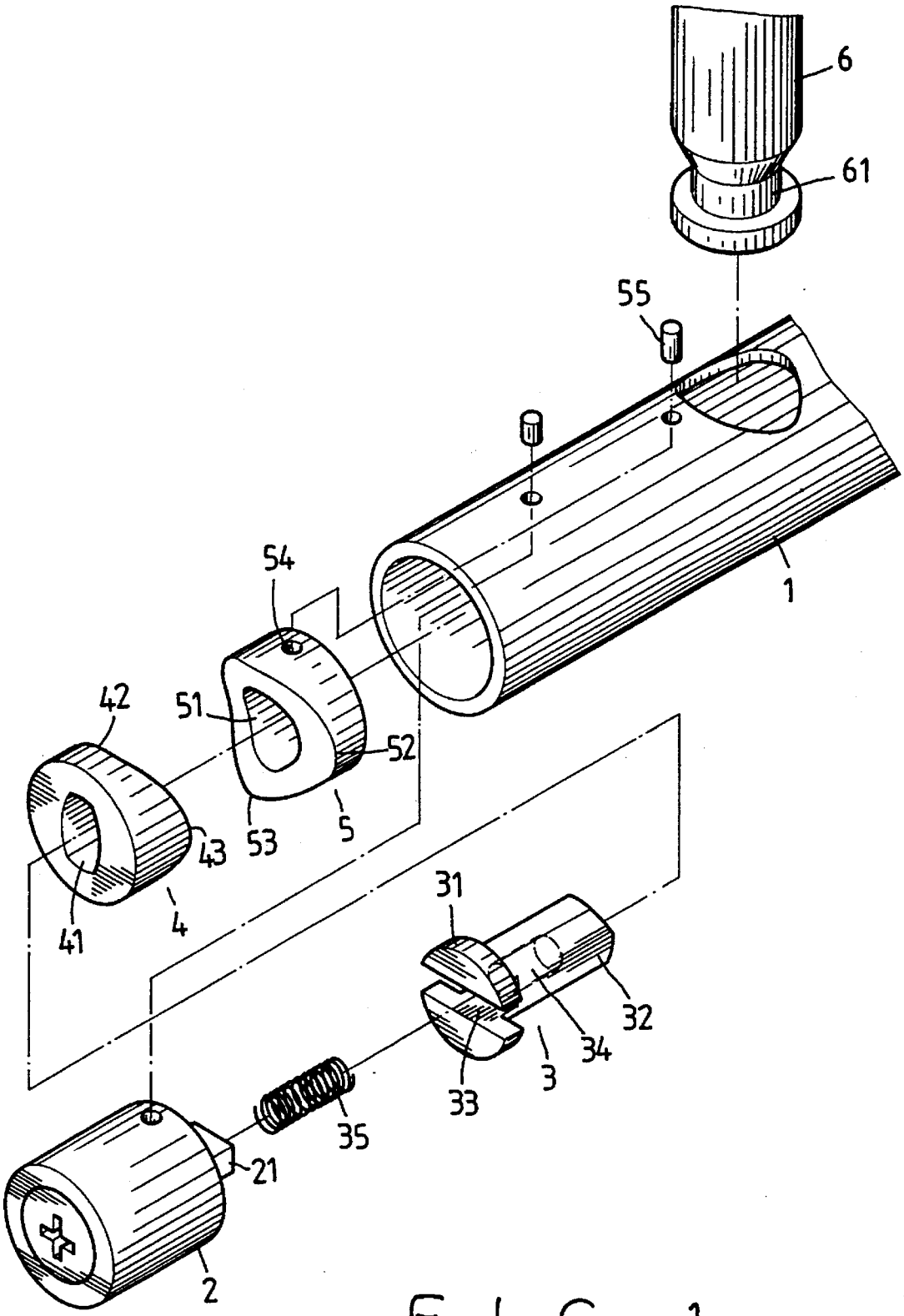
FIG. 1 is an exploded perspective view of the preferred embodiment of the present invention.
Figure 2:
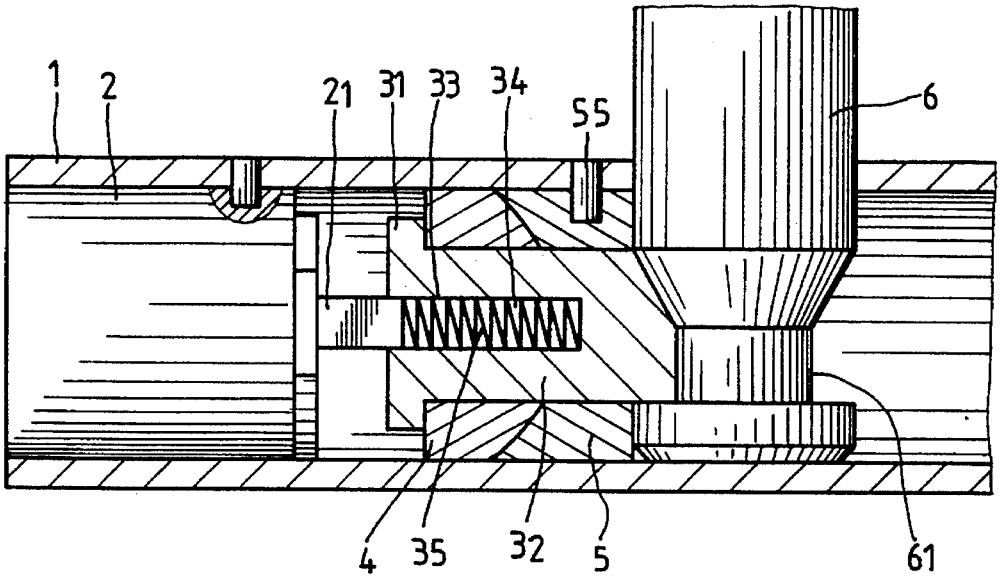
FIG. 2 is an elevational view, partially cut away, of the preferred embodiment of the present invention in a locked configuration.
Figure 3:
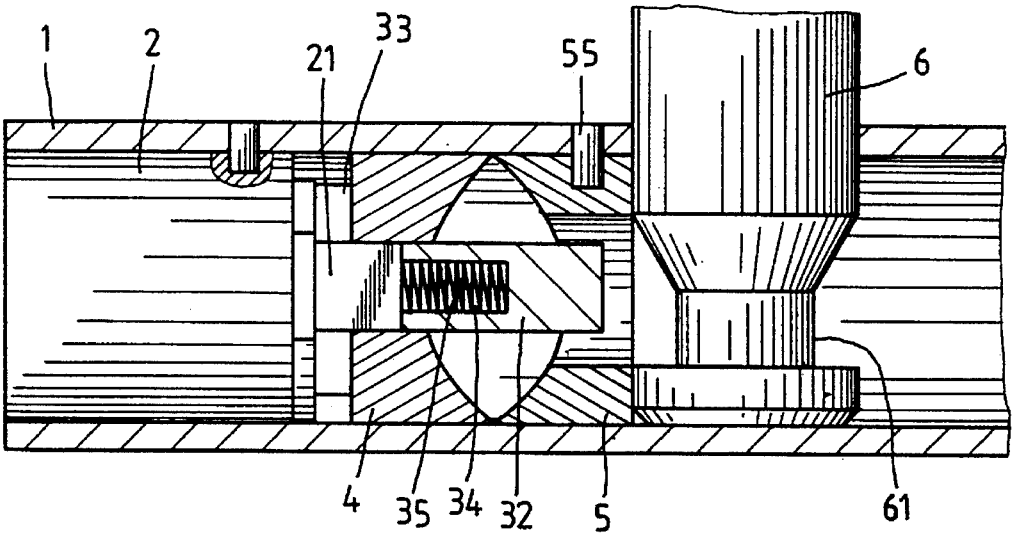
FIG. 3 is an elevational view, partially cut away, of the preferred embodiment of the present invention in an unlocked configuration.
Figure 4A:
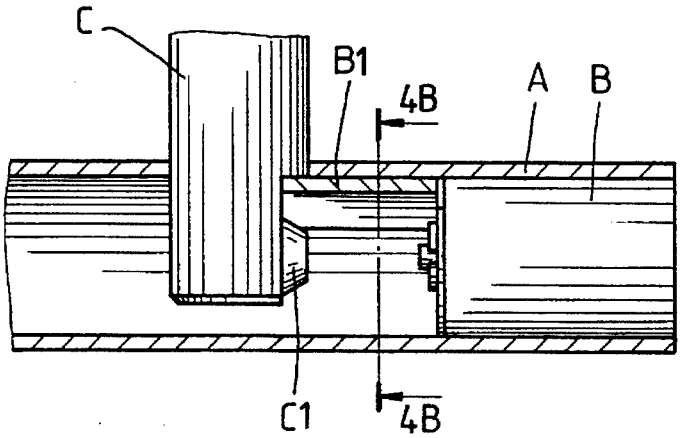
FIG. 4A (PRIOR ART)
FIG. 4A is an elevational view, partially cut away, of a prior art lock mechanism in a locked configuration.
Figure 4B:
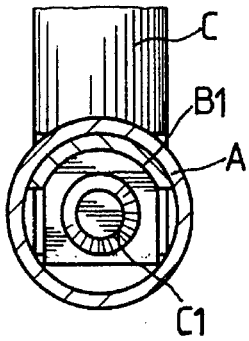
FIG. 4B (PRIOR ART)
FIG. 4B is a cross-sectional view taken along Line 4B—4B of FIG. 4A.
Figure 5A:
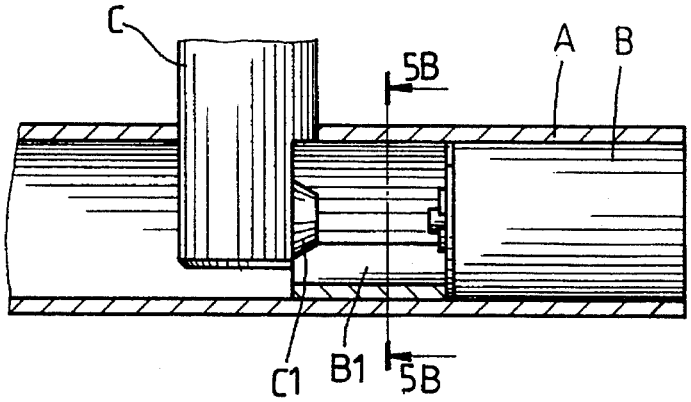
FIG. 5A (PRIOR ART)
FIG. 5A is an elevational view, partially cut away, of a prior art lock mechanism in an unlocked configuration.
Figure 5B:
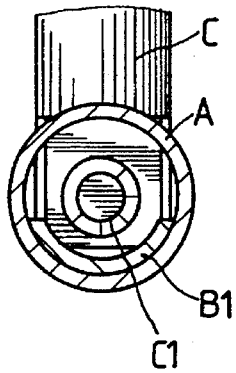
FIG. 5B (PRIOR ART)
FIG. 5B is a cross-sectional view taken along line 5B—5B of FIG. 5A.

Reference is now made to the Drawings, wherein the embodiments shown are shown for the purpose of illustrating a preferred embodiment only and not for the purpose of limiting the present invention. Referring to FIG. 1, there is shown the lock mechanism of the present invention comprising a lock housing 1 having an axial bore adapted to coaxially receive therein a lock core 2, an engaging member 3, a sliding member 4, and a fixed member 5. An opening is formed in a sidewall portion of lock housing 1 for the insert of a lock rod assembly 6 therein. First and second apertures are also formed in the sidewall portion of lock housing 1, axially displaced, as shown, from the lock rod assembly opening.

Lock core 2 generally has a cylindrical outer wall having a radially-extending aperture. Lock core 2 also has a protuberance 21 axially extending therefrom.

The engaging member 3 has formed on one end a head 31, an oval-shaped shank portion 32 extending axially from the head 31. Engaging member 3 preferably has a groove 33 formed on and across the head 31 for receiving the protuberance 21 of the lock core 2 therein, and a cavity extending longitudinally into the shank portion 32 for receiving therein a spring member 35.

Sliding block 4 is preferably a cylindrical wedge having an oval-shaped axial through opening 41 and a front face forming a first cam surface. The cam surface is formed as an undulating annulus having protruding segments 43 and depressed segments 42. The through opening 41 is shaped to receive the oval-shaped shank portion 32 of engaging member 3 with the head 31 abutting the leading edge of sliding member 4.

Fixed member 5 is also, generally, a cylindrical wedge and has a through opening 51 axially aligned with the through opening 41 of sliding member 4. Fixed member 5 also has a cam surface realized as an undulating annulus having protruding segments 53 and depressed segments 52 which forms a camming interface with the cam surface of sliding member 4. In the locked configuration, the protruding segments 43 of sliding member 4 are in contact with the depressed segments 52 of fixed member 5 such that the two members 4 and 5 form a secure, flush engagement. When sliding member 4 is rotated to place the lock mechanism is its unlocked configuration, the protruding segments 43 of sliding member 4 abut the protruding segments 53 of fixed member 5.

Lock rod assembly 6 is preferably a one-piece unit having a single recessed annular portion 61 formed adjacent one end. The lock mechanism of the present invention is assembled as follows. Fixed member 5 is placed into the axial bore of lock housing I and secured by inserting a pin 55 through the first aperture and into the aperture 54 formed in fixed member 5 to secure fixed member 5 within lock housing 1. A spring 35 is placed in the bore 34, and the protuberance 21 of the lock core 2 is inserted into the groove 33 of the head 31 of engaging member 3 to resiliently bias the member 3 toward lock rod assembly 6. The shank portion 32 of the engaging member 3 is received in the through opening 41 of sliding block 4. Lock core 2, engaging member 3, and sliding member 4, are then inserted into the axial bore of lock housing 1 in sequence. The shank portion 32 of engaging member 3 extends through the intervening members to engage the recessed portion 61 of lock rod assembly 6 to form a secure locking engagement therewith, when the lock mechanism is in its locked configuration.

When in use, a proper key is inserted into the keyway of lock core 2, and the protuberance 21 is rotated, causing sliding member 4 to turn responsively. This rotation causes the protruding segments 43 of sliding member 4 to move from their engagement with the depressed segments 52 into engagement with the protruding segments 53 of fixed member 5. This causes the engaging member 3 to be axially displaced away from lock rod assembly 6, and the shank portion 32 consequently disengages from the recessed portion 61 of lock rod assembly 6. The unlocked configuration of the locking mechanism thereby results.

To place the lock mechanism in its locked configuration, the key inserted into lock core 2 is again rotated such that the engaging member 3 and sliding member 4 are together rotated to allow the protruding segments 43 of sliding member 4 to engage the depressed segments 52 of fixed member 5. This enables the shank portion 32 to axially advance into engagement with the recessed portion 61 of lock rod assembly 6.

I claim:

1. A lock mechanism comprising:

(a) an elongate lock housing member extending in a longitudinal direction, said lock housing member having a sidewall portion coaxially encircling an axial bore;

(b) a fixed member fixedly received within said axial bore of said lock housing member, said fixed member having a fixed member through opening extending in said longitudinal direction and a fixed member cam surface formed as an undulating annulus having at least one depressed segment and at least one protruding segment;

(c) a sliding member slidably and rotatably received within said axial bore of said lock housing member, said sliding member having a sliding member through opening substantially aligned coaxially with said fixed member through opening, said sliding member having a sliding member cam surface opposing said fixed member cam surface for contiguous interface therewith, said sliding member cam surface being formed as an undulating annulus having at least one depressed segment and at least one protruding segment;

(d) a lock rod assembly slidably and substantially transversely received in said lock housing member, said lock rod assembly having a recessed portion;

(e) an engaging member coaxially coupled to said sliding member, said engaging member having an elongate shank portion for releasably engaging said recessed portion of said lock rod assembly and a head portion for preventing longitudinal displacement of said shank portion relative to said sliding member, said shank portion being inserted through said sliding member through opening to be rotatively fixedly coupled therewith; and, (f) a lock core coaxially coupled to said engaging member for reversibly actuating the rotation thereof, said engaging member being resiliently biased in said longitudinal direction.

* * * * *